US006430515B1

(12) United States Patent
Sanyal et al.

(10) Patent No.: US 6,430,515 B1
(45) Date of Patent: Aug. 6, 2002

(54) METHOD OF DETERMINING BAROMETRIC PRESSURE FOR USE IN AN INTERNAL COMBUSTION ENGINE

(75) Inventors: Amit K. Sanyal, Troy; Gregory L. Ohl, Ann Arbor; Chris D. Kapolnek, Dearborn; Timothy A. Coatesworth, Lake Orion, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/398,904

(22) Filed: Sep. 20, 1999

(51) Int. Cl.[7] ..... F02D 41/30

(52) U.S. Cl. ..... 702/50; 702/33; 702/98; 702/105; 702/183

(58) Field of Search ..... 702/33, 36, 44, 702/45, 47, 50, 98, 100, 105, 113, 114, 138, 140, 182, 183, 184, 188, FOR 123–124, FOR 127–128, FOR 129–130, FOR 134–135, FOR 143, FOR 170, FOR 171; 123/494; 73/118.2, 198, 117.3, 114

(56) References Cited

U.S. PATENT DOCUMENTS 4,600,993 A * 7/1986 Pauwels et al. ..... 364/431.05
4,750,352 A * 6/1988 Kolhoff ..... 73/117.3
4,787,043 A 11/1988 Zimmerman et al. ..... 701/103
4,926,335 A * 5/1990 Flowers et al. ..... 364/431.05
5,020,363 A * 6/1991 Schnaibel et al. ..... 73/119 A
5,029,569 A * 7/1991 Cullen et al. ..... 123/494
5,136,517 A * 8/1992 Cullen et al. ..... 364/431.05
5,396,794 A * 3/1995 Nichols ..... 73/118.1
5,535,620 A * 7/1996 Nichols ..... 73/118.1
5,714,683 A * 2/1998 Maloney ..... 73/118.2
5,740,045 A * 4/1998 Livshiz et al. ..... 364/431.03
5,753,805 A * 5/1998 Maloney ..... 73/118.2
5,996,553 A * 12/1999 Sanvido et al. ..... 123/339.23
6,016,460 A * 1/2000 Olin et al. ..... 701/102
6,283,107 B1 * 9/2001 Koerner ..... 123/676

* cited by examiner

*Primary Examiner*—Marc S. Hoff
*Assistant Examiner*—Carol S Tsai
(74) *Attorney, Agent, or Firm*—Ralph E. Smith; Edwin W. Bacon, Jr.

(57) ABSTRACT

A method is provided for determining the barometric pressure external to an air intake of an internal combustion engine, comprising the steps of: (a) providing a pressure value indicative of an absolute pressure in the intake manifold of the engine; (b) providing a mass airflow value of the airflow into the engine; (c) characterizing a pressure drop across the intake system based on the mass airflow value; and (d) determining a barometric pressure based on the pressure value and the pressure drop, such that the pressure drop is indicative of the pressure differential between the atmospheric pressure and the pressure in the intake manifold. Furthermore, the determination of the barometric pressure may be triggered when the throttle blade reaches a predetermined throttle threshold position which is a function of the rotational speed of the engine.

11 Claims, 3 Drawing Sheets

METHOD OF DETERMINING BAROMETRIC PRESSURE FOR USE IN AN INTERNAL COMBUSTION ENGINE

BACKGROUND OF THE INVENTION

1. Field of the Invention

The present invention relates generally to a method of determining barometric pressure for use in an internal combustion engine of a motor vehicle and, more particularly, to a method of determining barometric pressure based on the manifold absolute pressure and the mass airflow going into the engine, where mass airflow is indicative of a pressure drop between the atmospheric pressure and the manifold absolute pressure.

2. Discussion

Barometric pressure varies with weather conditions and altitude. In a motor vehicle, an accurate determination of barometric pressure is essential for various engine control functions. For instance, precise metering of the amount of air and fuel delivered to the engine is necessary to achieve the desired combustion as well as acceptable vehicle emissions. When the barometric pressure drops, typically the timing needs to be retarded and the fuel mixture richened. In addition, the barometric pressure may also be used to control idle bypass airflow, check for limp-in conditions and other diagnostic functions.

Typically, a barometric pressure sensor is used to measure the atmospheric pressure external to the airflow intake system of an internal combustion engine. In order to save the cost of a barometric sensor, it is desirable to provide a method of determining barometric pressure which may be used for engine control functions associated with a motor vehicle.

SUMMARY OF THE INVENTION

In accordance with the present invention, a method is provided for determining the barometric pressure external to an air intake of an internal combustion engine, comprising the steps of: (a) providing a pressure value indicative of an absolute pressure in the intake manifold of the engine; (b) providing a mass airflow value indicative of an airflow into the engine; (c) characterizing a pressure drop across the intake system based on the mass airflow value; and (d) determining a barometric pressure based on the pressure value and the pressure drop, such that the pressure drop is indicative of the pressure differential between the atmospheric pressure and the pressure in the intake manifold. Furthermore, the determination of the barometric pressure may be triggered when the throttle blade reaches a predetermined throttle threshold position which is a function of the rotational speed of the engine.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
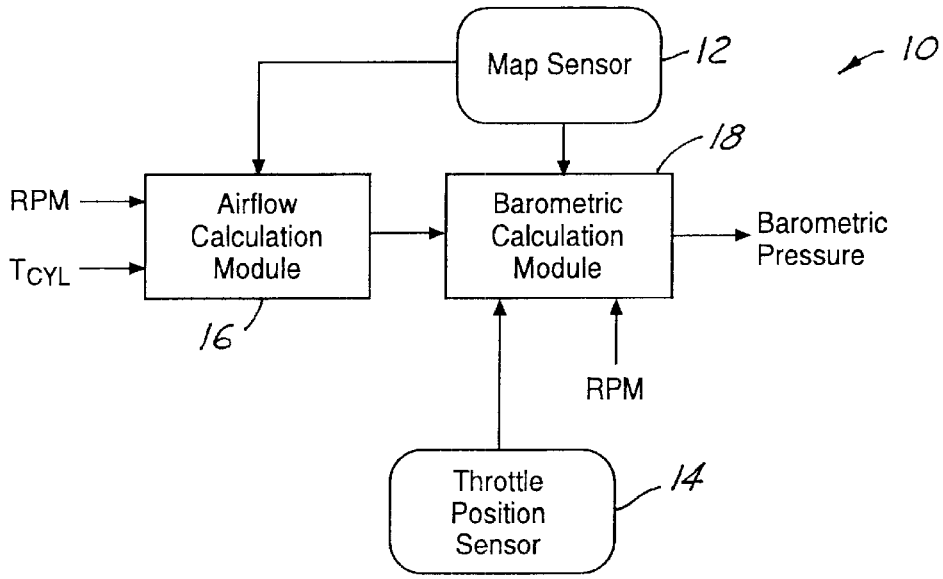
FIG. 1 is a block diagram showing the components of a barometric pressure determination system in accordance with the present invention.

A computer-implemented barometric pressure determination system 10 for determining the barometric pressure adjacent to an intake manifold of an internal combustion engine is depicted in FIG. 1. The barometric pressure determination system 10 includes a manifold absolute pressure sensor 12, a throttle position sensor 14, an airflow calculation module 16 and a barometric pressure calculation module 18.

Generally, the barometric calculation module 18 of the present invention determines the barometric pressure based on the manifold absolute pressure received from the manifold absolute pressure sensor 12 and the engine mass airflow received from the airflow calculation module 16. In addition, the barometric calculation module 18 receives an input from the throttle position sensor 14. As will be more fully explained, the barometric calculation module 18 only determines the barometric pressure when the engine achieves certain enablement conditions, for example, based on the position of the throttle plate as reported by the throttle position sensor 14.

Figure 2:
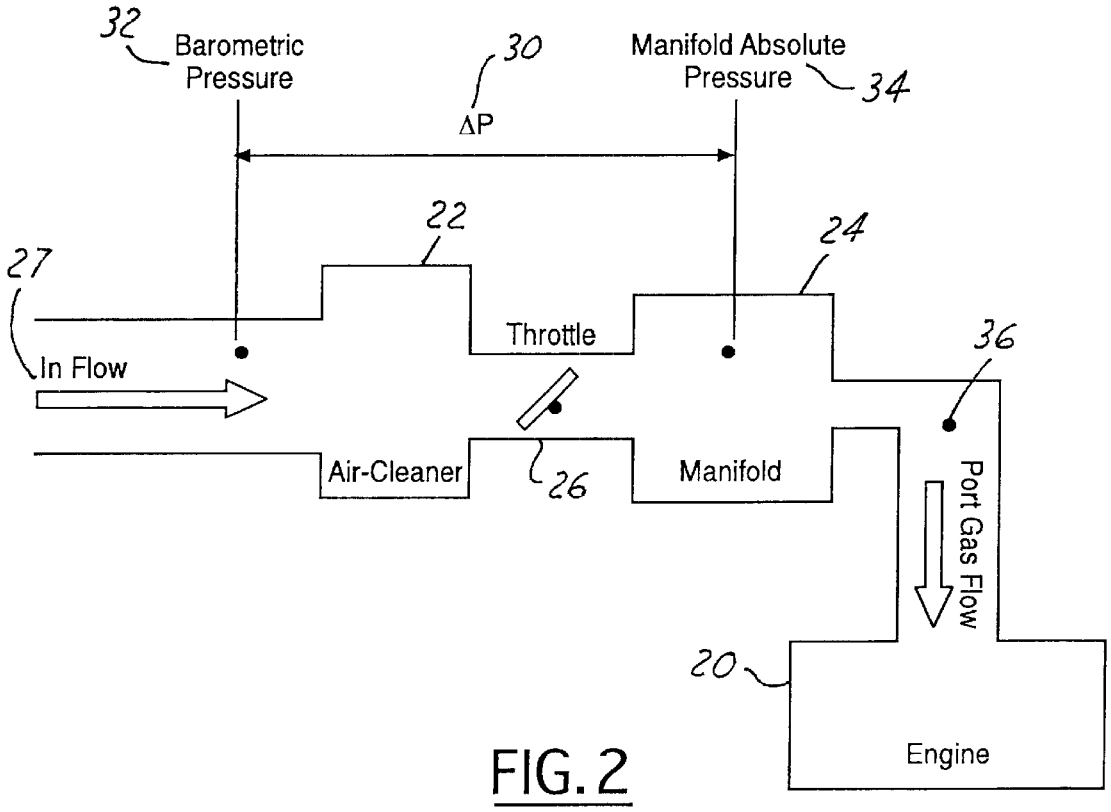
FIG. 2 is a diagram of a conventional air intake system for an internal combustion engine in accordance with the present invention.

FIG. 2 provides a diagrammatic view of a conventional air intake system for an internal combustion engine 20. Prior to reaching the engine 20, an external airflow passes through al air-cleaner 22 and then though an intake manifold 24. A throttle device 26 positioned before the intake manifold 24 is used to control the airflow into the engine 20. To provide an electrical signal indicative of the absolute pressure 34 in the intake manifold 24, the manifold absolute pressure sensor 12 is positioned downstream from the throttle device 26 in the intake manifold 24.

Figure 3:
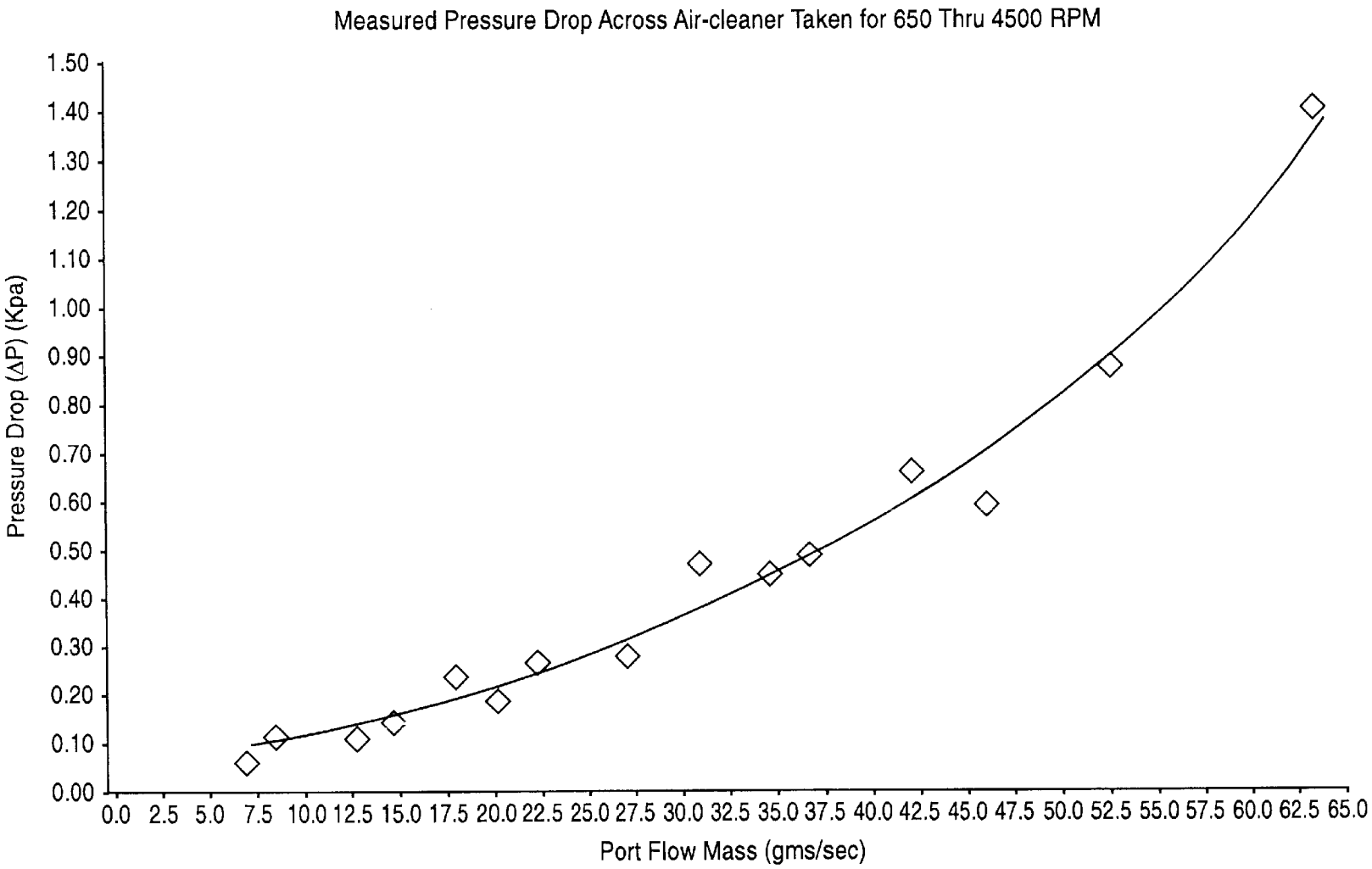
FIG. 3 is a graph illustrating the correlation between the engine port mass airflow and the pressure drop across the air intake system of the engine.

A pressure drop ($\Delta P$) 30 occurs between the barometric or atmospheric pressure 32 external to the air intake system and the manifold absolute pressure 34 in the intake manifold 24. Empirical testing in different types of internal combustion engines has shown that the pressure drop across the air intake system has a strong correlation with the engine port mass airflow as shown in FIG. 3. By characterizing the pressure drop 30 across the air intake system as a function of in flow 27 or engine port mass airflow 36, the upstream barometric pressure 32 can be obtained by adding the pressure drop to the manifold absolute pressure 34 (barometric pressure=$\Delta P$+MAP).

The engine port mass airflow 36 is typically calculated by an algorithm associated with the engine control module (not shown). For purposes of this discussion, the airflow calculation module 16 represents the algorithm which provides a value indicative of the mass airflow going into the engine. In a preferred embodiment, the airflow calculation module 16 employs the known speed-density relationship to calculate the engine port mass airflow 36. As will be apparent to one skilled in the art, the speed-density relationship is as follows:

$$\text{Mass Airflow} = \frac{RPM \times MAP \times \text{Volumetric Efficiency} \times \text{Displacement of the Engine} \times \text{Constant}}{R_{Air} \times T_{Cylinder}}$$

Although the speed-density relationship is presently preferred, other suitable estimates or measurements of the engine port mass airflow 36 or in flow 27 may be used in accordance with the present invention.

The relationship between the engine port mass airflow 36 and the pressure drop 30 assumes a fixed physical geometry for the intake system. Of course, the positioning of the throttle blade effects the physical geometry of the intake system, and thus effects the relationship between the engine port mass airflow 36 and the pressure drop 30 across the intake system. Accordingly, the barometric calculation module 18 only determines the barometric pressure when certain enablement conditions are achieved.

When the throttle blade is in a wide-open throttle position, empirical testing has shown the barometric pressure was most accurately determined by the barometric calculation module 18 of the present invention. Similarly, the relationship between engine port mass airflow and the pressure drop is not significantly altered when the throttle blade is partially closed from the wide-open throttle position. Therefore, in a preferred embodiment of the barometric calculation module 18, the determination of the barometric pressure is triggered by a predetermined throttle threshold position. To do so, a throttle position sensor connected to the throttle device 26 provides an electrical signal indicative of the position of the throttle plate to the barometric calculation module 18.

However, the geometry of the intake system begins to have an impact on the pressure drop characterization when the throttle blade approaches a closed throttle position. Moreover, this impact on the pressure drop varies with the rotational speed (i.e., RPM) of the engine. To provide a more robust triggering scheme, the present invention triggers the determination of the barometric pressure based on a predetermined throttle threshold position which is in turn a function of the rotational speed of the engine. An exemplary table of predetermined throttle threshold positions may be as follows:

| RPM | THROTTLE POSITION |
|---|---|
| 1000 | 1.5 V |
| 2000 | 2.0 V |
| 4000 | 3.0 V |
| 5000 | 3.5 V |

One skilled in the art will readily recognize that by using a calibration process, the above table of predetermined throttle threshold positions and corresponding RPM values can be derived for a particular engine configuration.

Figure 4:
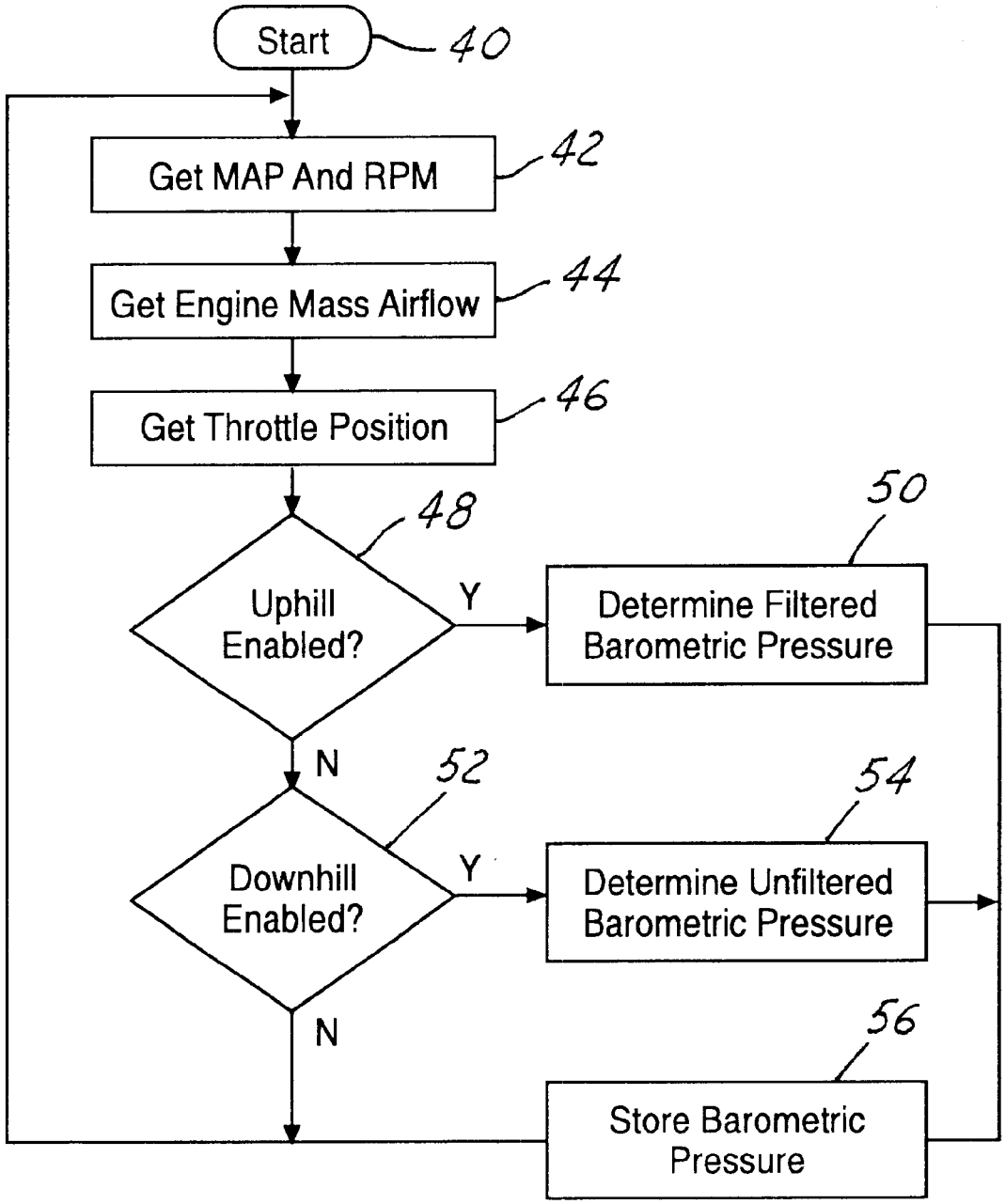
FIG. 4 is a flowchart of the preferred methodology employed by the barometric calculation module of the present invention.

FIG. 4 is a flowchart illustrating the preferred methodology employed by the barometric calculation module 18 of the present invention. Start block 40 signifies the beginning of the algorithm. Because barometric pressure is a relatively static parameter, it does not need to be continually calculated and/or updated by the barometric calculation module 18. On the contrary, the present invention employs a looping algorithm, such that barometric pressure is only calculated when certain enablement conditions are achieved. In order to check the enablement conditions, the barometric calculation module has access at any given time to the manifold absolute pressure, the engine port mass airflow, the engine rotational speed and the throttle position as shown in blocks 42, 44 and 46.

Although other factors can alter the barometric pressure, it is most likely to increase or decrease when the vehicle is driving downhill or uphill, respectively. Decision block 48 addresses the situation where the altitude is increasing and thus the barometric pressure is decreasing. In this case, the determination of the barometric pressure is triggered when an estimate of the current barometric pressure is less than a previously stored barometric pressure and the throttle position exceeds a predetermined throttle threshold position. For determination purposes, the current barometric pressure is estimated by adding a measured manifold absolute pressure to a previously characterized pressure drop. As a result, the enablement condition is as follows:

If (MAP+characterized ΔP (mass airflow))<stored barometric pressure and throttle position>predetermined throttle threshold position(RPM)

If enabled, block 50 determines the barometric pressure in accordance with the following equation:

Barometric pressure=filter*(MAP+characterized ΔP (mass airflow)) +(1-filter)*stored barometric pressure.

is As will be apparent to one skilled in the art, a first order software-implemented filter is used to avoid step changes in the output of the barometric calculation module 18.

On the other hand, when the altitude is decreasing, the barometric pressure is increasing. Decision block 52 addresses the most likely scenario where the vehicle is travelling downhill and the barometric pressure is increasing. Because it is unlikely that the throttle position will appreciably change when travelling downhill, the enablement condition is only based on a change in the barometric pressure. In this case, the enablement condition is as follows:

If (MAP+characterized ΔP (mass airflow))>stored barometric pressure Similarly, if enabled, block 54 determines the barometric pressure in accordance with the following equation:

Barometric pressure=MAP+characterized ΔP (mass airflow)

In either case, after the barometric pressure is determined, the calculated barometric pressure is stored in memory as shown in block 56. Lastly, processing returns to the beginning of the algorithm at block 42.

While the above description constitutes the preferred embodiment of the invention, it will be appreciated that the invention is susceptible to modification, variation, and change without departing from the proper scope or fair meaning of the accompanying claims.

We claim:

1. A method of determining barometric pressure for use in an internal combustion engine, comprising the steps of:

providing a pressure value indicative of an absolute pressure in an intake manifold of the engine;

providing a mass airflow value of the airflow into the engine, where said mass airflow value is indicative of a pressure drop between an atmospheric pressure adjacent to the intake manifold and the absolute pressure in the intake manifold;

determining when a throttle position of a rotatable throttle plate in a throttle device achieves a predetermined throttle threshold position, wherein the predetermined throttle threshold position is based on a rotational speed of the engine; and upon determination that the throttle position has achieved the predetermined throttle threshold position, determining a barometric pressure based on said pressure value and said pressure drop.

2. The method of claim 1 wherein the step of determining barometric pressure further comprises calculating barometric pressure by adding said pressure value to said pressure drop.

3. The method of claim 1 wherein the step of determining barometric pressure further comprises determining said predetermined throttle threshold position such that the mass airflow value is indicative of said pressure drop between the atmospheric pressure and the manifold absolute pressure.

4. A method of determining barometric pressure for use in an internal combustion engine, comprising the steps of:

determining a throttle position of a rotatable throttle plate of a throttle device associated with the engine;

determining a rotational speed of the engine; and determining a barometric pressure when the throttle position achieves a predetermined throttle threshold position and the rotational speed achieves a predetermined engine rotational speed, said predetermined throttle threshold position being a function of said rotational speed of the engine.

5. The method of claim 4 wherein the step of determining a barometric pressure further comprises:

providing a pressure value indicative of an absolute pressure in an intake manifold of the engine;

providing a mass airflow value of the airflow into the engine, where said mass airflow value is indicative of a pressure drop between an atmospheric pressure adjacent to the intake manifold and the absolute pressure in the intake manifold; and calculating the barometric pressure based on said pressure value and said pressure drop.

6. The method of claim 5 wherein the step of calculating the barometric pressure further comprises adding said pressure value to said pressure drop.

7. The method of claim 6 wherein the step of determining a barometric pressure further comprises determining said predetermined throttle threshold position such that the mass airflow value is indicative of said pressure drop between the atmospheric pressure and the manifold absolute pressure.

8. An apparatus for determining a barometric pressure adjacent to an air intake of an internal combustion engine, comprising:

a manifold absolute pressure sensor positioned in an intake manifold of the engine for providing a pressure value indicative of an absolute pressure in said intake manifold;

an airflow calculation module for providing a mass airflow value of the airflow into the engine, where said mass airflow value is indicative of a pressure drop between an atmospheric pressure adjacent to said intake manifold and the absolute pressure in the intake manifold;

a barometric calculation module connected to said manifold absolute pressure sensor and said airflow calculation module for determining the barometric pressure based on said pressure value and said pressure drop;

a throttle device positioned before the intake manifold, said throttle device having a rotatable throttle plate;

a throttle position sensor connected to said throttle device for providing a signal indicative of the position of said throttle plate; and said barometric calculation module receiving the signal from said throttle position sensor and being operative to determine the barometric pressure when the position of said throttle plate reaches a predetermined throttle threshold position, wherein the predetermined throttle threshold position is based on an engine rotational speed of the engine.

9. The apparatus of claim 8 wherein the barometric pressure is determined by adding said pressure value to said pressure drop.

10. The apparatus of claim 8 wherein said predetermined throttle threshold position is determined such that the mass airflow value is indicative of a pressure variance between the barometric pressure and the pressure in the intake manifold.

11. The method of claim 1 further comprising:

an uphill detection step comprising determining whether the current barometric pressure is less than a previously stored barometric pressure;

a downhill detection step comprising determining whether the current barometric pressure is greater than a previously stored barometric pressure; and selectively applying a filter to said barometric pressure in response to said uphill detection step and said downhill detection step.

* * * * *